United States Patent [19]

Fishman et al.

[11] Patent Number: 4,953,761

[45] Date of Patent: Sep. 4, 1990

[54] STOPPER ROD SPATIAL CONTROL MECHANISM

[75] Inventors: Oleg Fishman, Maple Glen, Pa.; Satyen N. Prabhu, Maple Shade; John P. Burk, Mt. Holly, both of N.J.; Emad Tabatabaei, Bensalem, Pa.

[73] Assignee: Inductotherm Corp., Rancocas, N.J.

[21] Appl. No.: 249,806

[22] Filed: Sep. 27, 1988

[51] Int. Cl.[5] ..... B22D 37/00

[52] U.S. Cl. ..... 222/602; 164/337; 164/437

[58] Field of Search ..... 164/337, 437, 133, 488; 222/601, 602

[56] References Cited

U.S. PATENT DOCUMENTS

| | | | |
|---|---|---|---|
| 2,753,606 | 7/1956 | Fogt | 222/602 |
| 3,627,180 | 12/1971 | Montgomery | 222/602 |
| 3,762,605 | 10/1973 | Seaton | 222/602 |
| 4,196,829 | 4/1980 | Seaton | 222/602 |
| 4,410,112 | 10/1983 | Fasano et al. | 222/602 |
| 4,744,407 | 5/1988 | Fishman et al. | 164/457 |

FOREIGN PATENT DOCUMENTS

| | | | |
|---|---|---|---|
| 166049 | 1/1905 | Fed. Rep. of Germany | 222/602 |
| 1269297 | 5/1968 | Fed. Rep. of Germany | 222/602 |
| 1815265 | 2/1970 | Fed. Rep. of Germany | 164/337 |
| 1960192 | 4/1971 | Fed. Rep. of Germany | 222/602 |
| 1028231 | 5/1953 | France | 222/602 |
| 72662 | 4/1985 | Japan | 164/337 |
| 118967 | 5/1987 | Japan | 222/602 |
| 197712 | 12/1977 | U.S.S.R. | 222/602 |
| 1246439 | 9/1971 | United Kingdom | 222/602 |

*Primary Examiner*—Richard K. Seidel
*Assistant Examiner*—Edward A. Brown
*Attorney, Agent, or Firm*—Seidel, Gonda, Lavorgna & Monaco

[57] ABSTRACT

The instant invention is directed to a stopper rod spatial control mechanism for use in combination with a bottom discharge holding reservoir for molten metal having a nozzle. The mechanism comprises a base, an outer tube and an inner tube. The outer tube has a longitudinal axis which is perpendicular to the base. The outer tube is swingably mounted about an axis parallel to and spaced away from the longitudinal axis. The inner tube is telescopically mounted within the outer tube. The inner tube is reciprocally movable along the longitudinal axis and is rotatable about the longitudinal axis. A servomotor is mounted at a lower end of the outer tube. A ball screw is connected to and rotated by the motor. A ball nut is affixed to the inner tube and cooperates with the ball screw. A boom having a first end and a second end is affixed to the inner tube adjacent its first end and rotates with the inner tube about the longitudinal axis. A stopper rod depends from the second end of the boom. A brake is affixed to the base and cooperates with the boom. The stopper rod is aligned with the nozzle by the combined movements of rotating the inner tube about the longitudinal axis and swinging the outer tube about the axis parallel to said longitudinal axis. Once the stopper rod is aligned, the position of the stopper rod is fixed by the brake. Thereafter, reciprocal movement of the stopper rod above the nozzle is controlled by the actuation of the servomotor.

15 Claims, 5 Drawing Sheets

STOPPER ROD SPATIAL CONTROL MECHANISM

FIELD OF THE INVENTION

The instant invention is directed to a stopper rod spatial control mechanism for use in combination with a bottom discharge holding reservoir for molten metal. The control mechanism allows a stopper rod to be precisely aligned with the reservoir's nozzle. The control mechanism includes a servomotor for controlling the vertical movement of the stopper rod into and out of engagement with the nozzle.

BACKGROUND OF THE INVENTION

In foundry installations, molten metal may be discharged from a bottom discharge holding reservoir into a mold. The flow control of molten metal from the reservoir to the mold is extremely important for the successful molding of metal parts. Accordingly, a stopper rod control mechanism is used to control the flow of molten metal through the reservoir's nozzle into the mold. The stopper rod mechanism thereby insures that the sprue cup of the mold is properly filled at all times during molding so that the molten metal propagates through the gating system of the mold and then into mold cavities.

Two problems inherently arise with the use of the stopper rod control mechanism. The first problem is associated with the flow rate of metal through the nozzle; the second, with the complete stoppage of metal flow through the nozzle.

The solution to the first problem requires that the stopper rod be quickly reciprocated in the vertical direction and quickly stopped to insure a proper rate of flow of material through the nozzle. The speed and precision of this vertical movement is important to insure proper flow rate so that the sprue cup of the mold is always properly filled.

The solution to the second problem requires that the rod be properly seated within the nozzle thereby insuring complete closure of the nozzle. This solution requires consideration of several factors. The rod must be movable in relation to the nozzle so that the rod can be properly aligned with the nozzle. Slag formation upon the nozzle is prevalent in these molding operations, so it is necessary to be able to vary the seating force (prestress) of the rod so that slag can be crushed off the nozzle. However, this force cannot be so great that it will deform the rod and nozzle.

In response to these problems, various manufacturers have attempted to solve them by primarily pneumatic means. For example, a mechanism manufactured by Seaton includes an air cylinder to operate the initial vertical movement of the stopper and the stroke of the stopper rod is adjusted with a ball screw and motor mechanism.

A mechanism manufactured by Brown Boveri actuates the vertical movement of the stopper rod with an air operated cylinder which is controlled by solenoids. Additionally this mechanism has the following disadvantages: no flexibility to allow alignment between a mismatched nozzle and rod; the stopper rod is not easily replaced; the position and velocity control of the rod is not possible; and the seating force of the rod into the nozzle is not a variable.

a mechanism manufactured by ASEA uses an air cylinder to actuate vertically reciprocal linear movement of the stopper rod. The stroke of the stopper rod is adjusted by a second air cylinder.

A mechanism manufactured by George Fisher includes a pneumatic diaphragm which operates a parallelogram mechanism that moves the stopper rod up and down. This mechanism includes a feature which allows the stopper rod to be twisted.

The above described mechanisms have the following disadvantages which adversely affect the use of such mechanisms and the process of filling mold:

1. low speed;
2. excessive and uncontrollable seating force of the rod in the nozzle (prestress);
3. arc motion instead of strict vertical linear motion of the rod;
4. no provision for accurately aligning the stopper rod and the nozzle; and
5. a laborious stopper rod replacement procedure.

SUMMARY OF THE INVENTION

The instant invention is directed to a stopper rod spatial control mechanism for use in combination with a bottom discharge holding reservoir for molten metal having a nozzle. The mechanism comprises a base, an outer tube and an inner tube. The outer tube has a longitudinal axis which is perpendicular to the base. The outer tube is swingably mounted about an axis parallel to and spaced away from the longitudinal axis. The inner tube is telescopically mounted within the outer tube. The inner tube is reciprocally movable along the longitudinal axis and is rotatable about the longitudinal axis. A servomotor is mounted at a lower end of the outer tube. A ball screw is connected to and rotated by the motor. A ball nut is affixed to the inner tube and cooperates with the ball screw. A boom having a first end and a second end is affixed to the inner tube adjacent its first end and rotates with the inner tube about the longitudinal axis. A stopper rod depends from the second end of the boom. A brake is affixed to the base and cooperates with the boom. The stopper rod is aligned with the nozzle by the combined movements of rotating the inner tube about the longitudinal axis and swinging the outer tube about the axis parallel to said longitudinal axis. Once the stopper rod is aligned, the position of the stopper rod is fixed by the brake. Thereafter, reciprocal movement of the stopper rod above the nozzle is controlled by the actuation of the servomotor.

A first advantage of the instant invention is to provide a servomotor which precisely controls the vertical movement of the stopper rod into and out of engagement with the nozzle, allows the seating force (prestress) of the rod into the nozzle to be varied and provides precise control of the position of the rod with regard to the nozzle.

A second advantage of the instant invention is that the combination of the swingable movement of the outer tube and the rotational movement of the inner tube allows precise alignment of the stopper rod and the nozzle.

A third advantage of the instant invention is the provision of the braking mechanism which holds the alignment between the stopper rod and nozzle.

A fourth advantage of the instant invention is the provision of a retractable pin which interconnects the boom and the braking mechanism which when removed allows the boom to be swung away from the reservoir thereby easing the replacement of the stopper rod.

A fifth advantage of the instant invention is the provision of a stopper rod clamp which quickly engages and disengages the stopper rod assembly. The clamp eases the replacement of the stopper rod.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
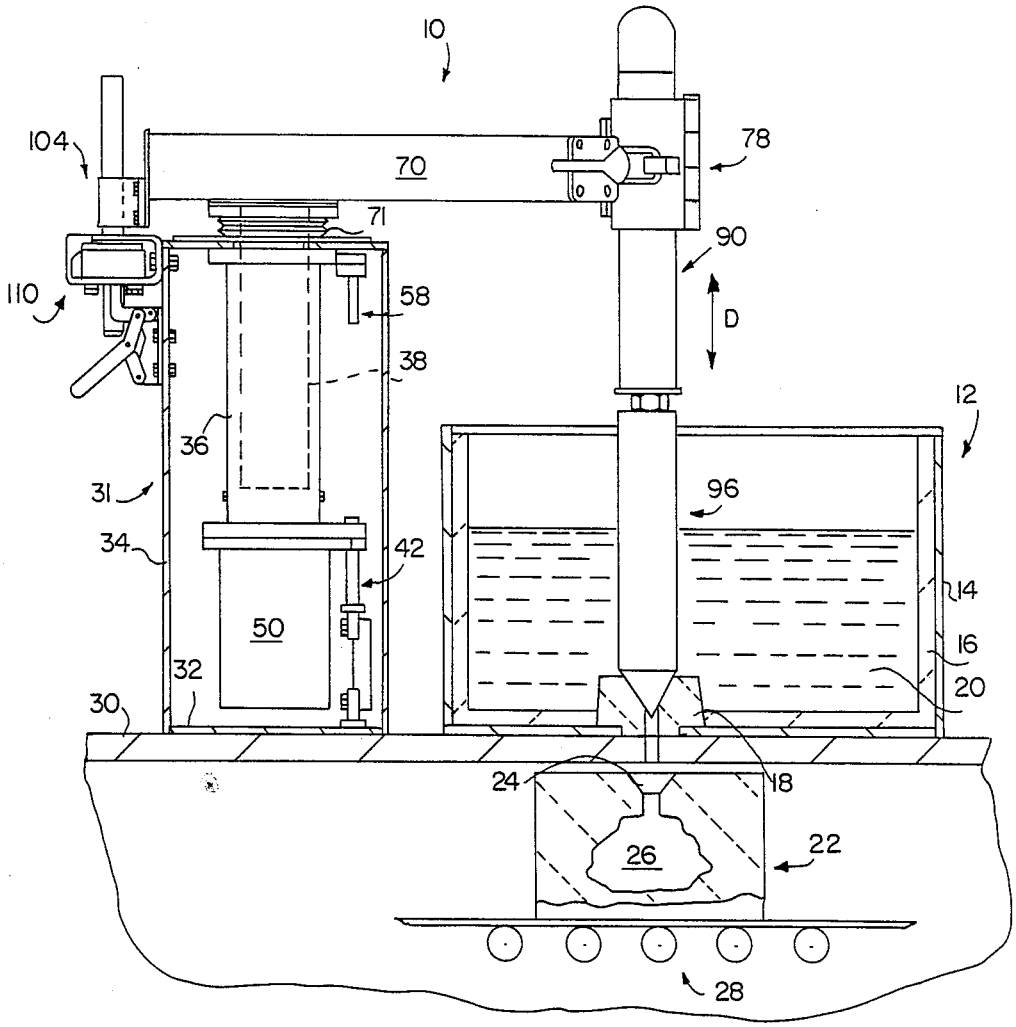
FIG. 1 is a cross sectional, elevational view of the instant invention in use with a reservoir positioned over a mold.

Referring to the drawing wherein like numerals indicate like elements, there is shown in FIG. 1 a stopper rod spatial control mechanism 10 in combination with reservoir 12 positioned over a mold 22. Reservoir 12 comprises a metal box 14 having a refractory lining 16 and a nozzle 18 made of refractory materials. Reservoir 12 is placed on a floor 30 adjacent stopper rod spatial control mechanism 10. Mold 22 is located below floor 30, so that sprue cup 24 of mold 22 is positioned directly below nozzle 18. This allows molten metal 20 to flow, by gravity, through nozzle 18 into the sprue cup 24 and then into cavity 26. Mold 22 may be placed on a conveyor 28 so that after complete filling of mold cavity 26, a next mold (not shown) may be automatically located under nozzle 18.

Stopper rod spatial control mechanism 10 generally comprises a housing 31 which may be anchored to floor 30. Outer tube 36, inner tube 38, servomotor 50, lower pivot 42 and upper pivot 58 are enclosed within housing 31. A boom 70 is interconnected to motor 50 via inner tube 38 so that motor 50 controls the vertical reciprocal movement of boom 70. Stopper rod clamp 78 is located at one end of boom 70 and retractable pin assembly 104 is located at its opposite end. Stopper rod clamp 78 releasably holds an adaptor 90. A stopper rod 96, made of, for example, graphite or graphite-based material, is located at the terminal end of adaptor 90. Retractable pin assembly 104 is engagable with a braking mechanism 110 which is mounted on housing 31. Each of the above described components and their interrelationships will be discussed in greater detail hereinafter.

Figure 2:
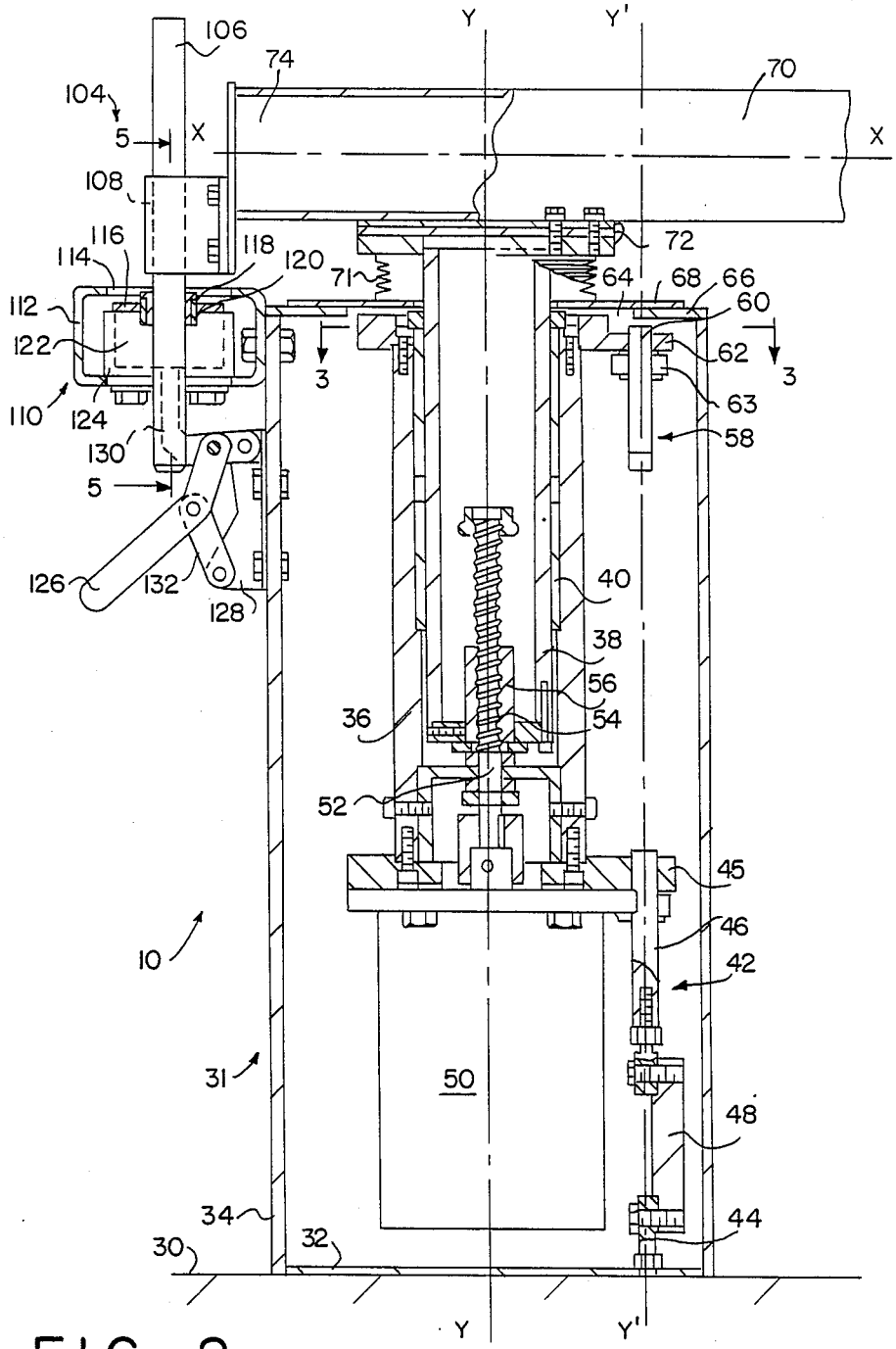
FIG. 2 is an elevational view of a portion of the instant invention.
Figure 3:
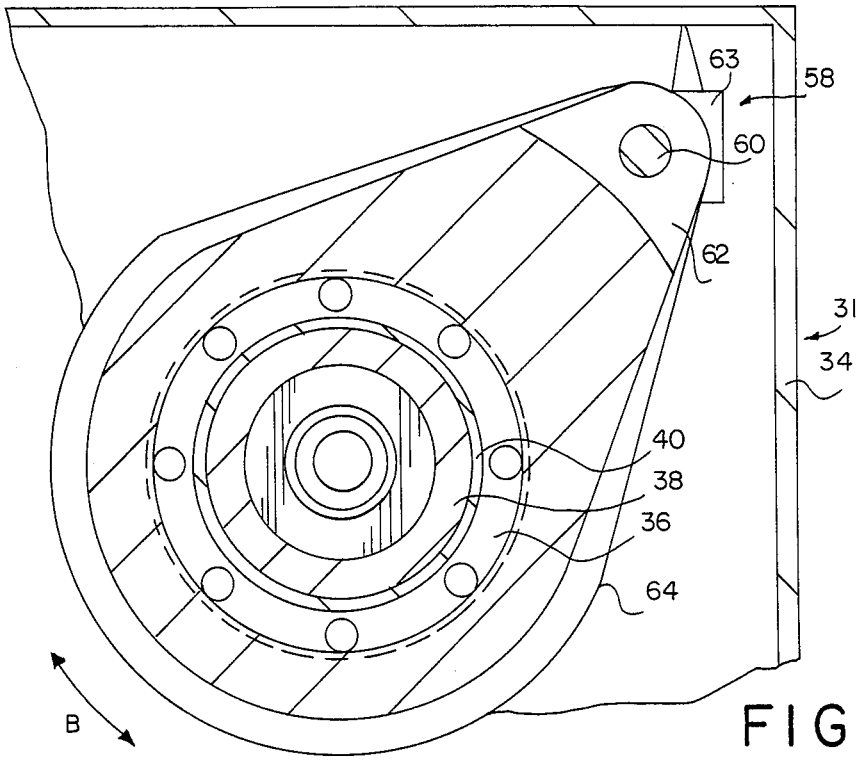
FIG. 3 is a sectional, top plan view taken generally along lines 3—3 of FIG. 2.

Referring to FIG. 2, housing 31 preferably includes an annular wall 34 which is affixed to base 32, preferably a flat circular plate, which may be anchored, in any conventional manner, to floor 30. Top plate 66 is affixed to the upper end of wall 34. Top plate 66 has an opening 64 therethrough (see FIG. 3) to provide space to swing the outer tube 36 within housing 31, as will be described below. A sliding cover plate 68 is fitted around but not affixed to inner tube 38, so that opening 64 is closed through all swinging movement of outer tube 36. Bellows 71 interconnects plate 68 and boom 70 via flanges 72. Thus, the combination of wall 34, base 32, top plate 66, sliding plate 68 and bellows 71 cooperates to prevent the inflow of contaminants into the internal cavity of the housing.

Outer tube 36 is swingably mounted for lateral movement within housing 31 via lower pivot assembly 42 and upper pivot assembly 58. See Arrow B in FIGS. 3 and 6. Outer tube 36 has longitudinal axis Y—Y. Lower pivot assembly 42 and upper pivot assembly 58 are vertically aligned to define an axis Y'—Y'. Axis Y'—Y' is parallel to but spaced away from longitudinal axis Y—Y. Outer tube 36 is reciprocally rotatable about axis Y'—Y'. Axis Y'—Y' is a stationery axis and axis Y—Y is a mobile axis. Axis Y'—Y' is stationery in the sense that it is fixed to housing 31. Axis Y—Y is mobile in the sense that it is reciprocally rotatable or swingable about axis Y'—Y'.

Lower pivot assembly 42 pivotally interconnects the lower most end of outer tube 36 to base 32. Lower pivot assembly 42 comprises plate 45 which is affixed to the lower most end of tube 36. Upper rod 46 is pivotally connected at its upper most end to plate 45. A mechanical member 48 is connected at is uppermost end to the lowermost end of rod 46. Lower rod 44 is connected at its uppermost end to the lowermost end of member 48. The lowermost end of rod 44 is connected to base 32. Lower pivot assembly 42 is designed so that it can support the entire weight of the inner and outer tubes, the servomotor, the boom, the adapter and the stopper rod.

Upper pivot assembly 58 pivotally interconnects the uppermost end of outer tube 36 to housing 34. Upper pivot assembly 58 comprises a generally egg shaped plate 62 (see FIG. 3) which is affixed to the uppermost end of outer tube 36. Plate 62 is sized so that it is movable within opening 64 (see FIG. 3). Upper pin 60 is affixed to plate 62. Upper pin 62 is pivotally connected to bearing 63 which is mounted on housing 31 via a brace 61. Upper pivot assembly 58 is designed so that it can support the entire weight of the inner and outer tubes, the servomotor, the boom, the adapter and the stopper rod.

To insure proper lateral swinging movement of the outer tube 36, rod 46 and pin 62 are vertically aligned to define axis Y'—Y' Outer tube 36 is neither vertically movable along longitudinal axis Y—Y nor rotatable about longitudinal axis Y—Y.

Servomotor 50, well known to those of ordinary skill in the art, is affixed to outer tube 36 via plate 45. Servomotor 50 is preferably an AC servomotor. Drive shaft 52 extends out of motor 50 and into tube 36, preferably along longitudinal axis Y—Y. Ball screw 54 is affixed to shaft 52 in a conventional manner, and is preferably aligned with longitudinal axis Y—Y. Servomotor 50 controls the vertical movement, both position and velocity, of stopper rod 96. Motor 50 is preferably actuated by a controller (for example see U.S. Pat. No. 4,744,407 which is incorporated herein by reference) which monitors the level of molten metal in the sprue cup 24. The controller regulates the flow of material from nozzle 18 by actuating motor 50 to cause the vertical movement and positioning of stopper rod 96 above nozzle 18. The motor 50 cooperates with the controller by providing the controller with information about the stopper rod's current position. The motor 50 can also be used to vary the seating force of the stopper rod 96 on nozzle 18 by varying the torque produced by the motor. The motor 50 can also be controlled manually or limit switches can be used to automatically control the stroke of rod 96.

Ball screw 54 is preferably a high pitch ball screw, so that in the event of power failure to motor 50, the weight of the boom 70 and those components attached to the boom will allow stopper rod 96 to fall into nozzle 18. This is a preferred safety feature of the invention, but it is not essential to the operation of the invention and other known mechanism could obtain the same result. The pitch of ball screw 54 is preferably in the range of about 15°-45°. The combination of the high pitch ball screw and servomotor allows precise control of the vertical movement of the stopper rod and the seating force of the stopper rod in the nozzle. Small rotations of the ball screw by the servomotor translate in relatively large vertical movement of the stopper rod. Varying the torque produced by the servomotor allows the seating force of the stopper rod to be varied. Moreover, the use of the high pitch ball screw eliminates the need for low inertia motors.

Inner tube 38 is vertically and reciprocally movable along the Y—Y axis, is rotatable about the Y—Y axis and is swingable about the Y'—Y' axis along with outer tube 36.

Inner tube 38 is telescopically mounted within outer tube 36 via bronze bushings 40. Bushing 40 allows tube 38 to vertically reciprocate within tube 36 and to rotate within tube 36. Ball nut 56 is affixed adjacent the lower most end of inner tube 38 and is in communication with ball screw 54. Rotation of ball screw 54, causes the vertical movement of inner tube 38 in a known manner.

A boom 70 is affixed to inner tube 38 via flanges 72 in a known manner. The longitudinal axis X—X of boom 70 is preferably perpendicular to axis Y—Y. Boom 70 is a box beam with a length sufficiently long to span the horizontal distance between the braking mechanism 110 and nozzle 18. Boom 70 is rotatable, along with inner tube 38, about longitudinal axis Y—Y.

Figure 4:
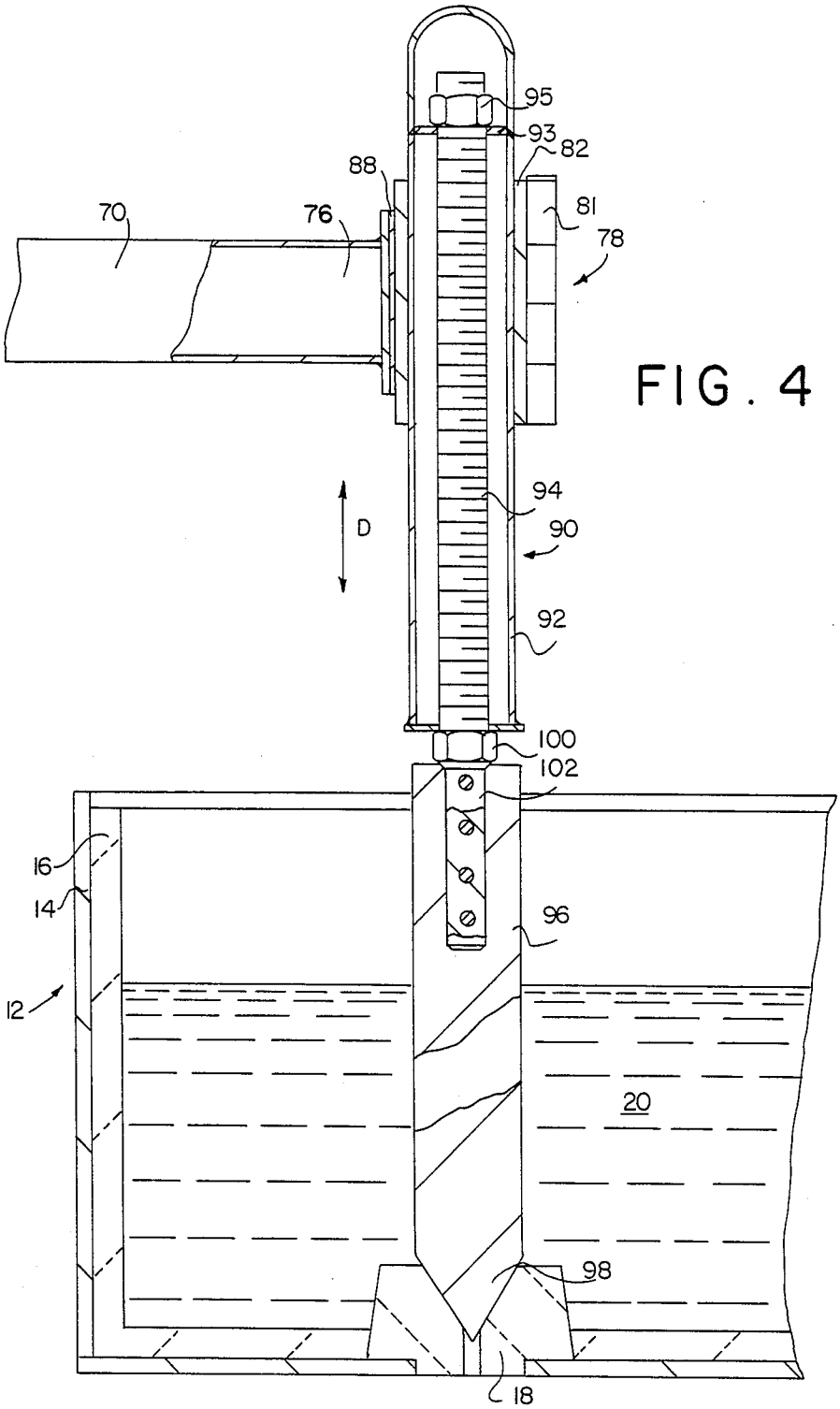
FIG. 4 is an elevational view of a portion of the instant invention.
Figure 6:
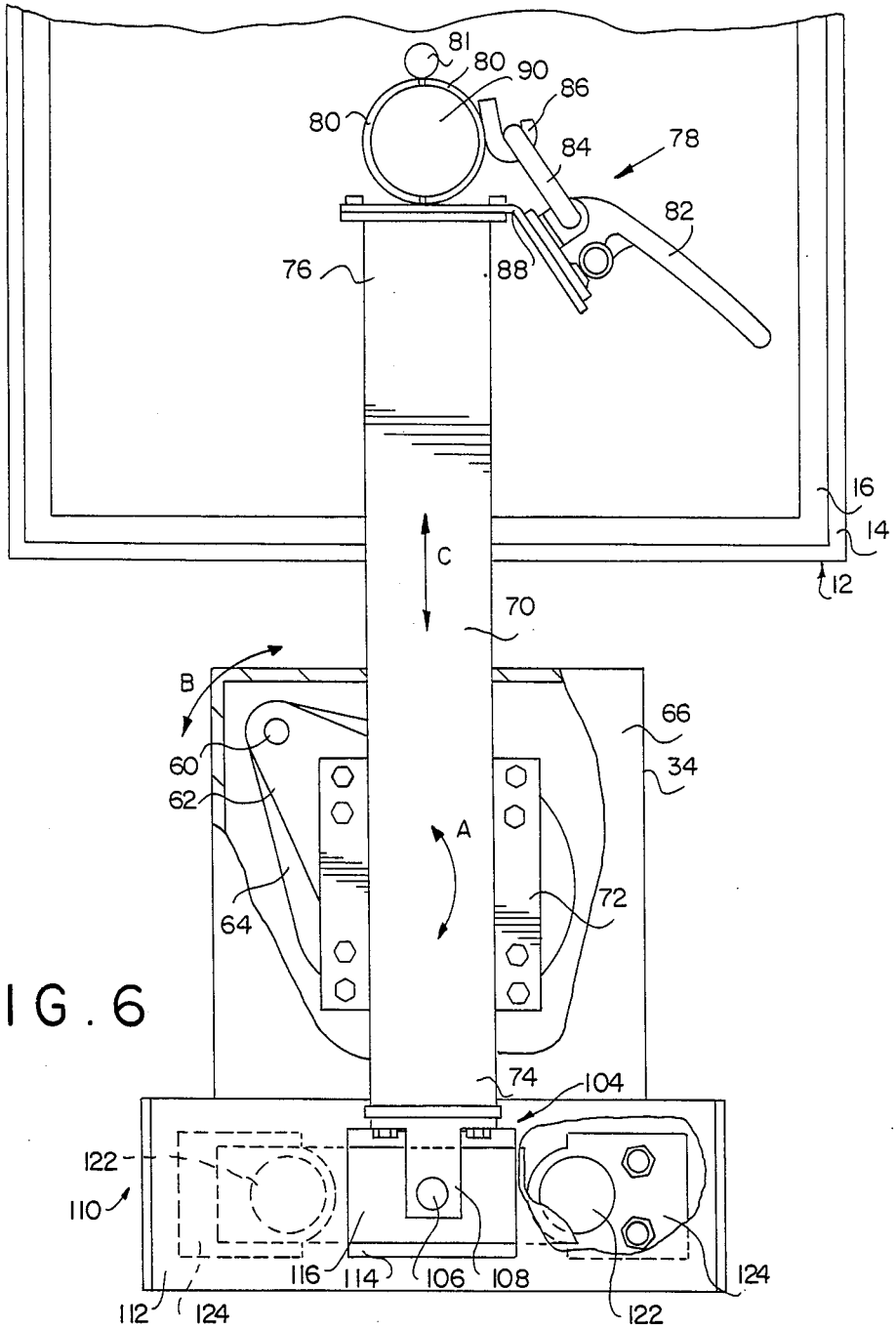
FIG. 6 is a top plan view of the instant invention.

Referring to FIGS. 4 and 6, second end 76 of boom 70 and its attachments are illustrated. A stopper rod clamp assembly 78 is mounted to second end 76 of boom 70 via a bent plate 88. Split sleeves 80 joined together by a hinge 81 are mounted on plate 88 in a known manner. Only one sleeve 80 is affixed to plate 88, the other sleeve is allowed to pivot on hinge 81. The pivotal sleeve 80 has a hook 86 attached thereto. Hook 86 is connected to a locking handle 82, mounted on plate 88, via linkage 84. Thus, split sleeves 80 may be opened or locked closed thereby holding an adaptor 90. This allows the stopper rod to be quickly changed thereby reducing the labor expense associated with changing the stopper rod.

Adaptor 90, see FIG. 4, comprises a housing 92. Vertical adjustment screw 94 is held within housing 92 via adjustment nut 95 which engages a plate 93. The hemispherical end of adaptor housing 92 is removable thereby providing access to nut 95 which allows vertical adjustment of screw 94.

Stopper rod 96 is fastened to adaptor 90 by a connector rod 102 which engages screw 94 and is locked in place by locking nut 100. Stopper rod is preferably cylindrical in shape and has a conical tip 98 which engages nozzle 18. Tip 98 may also be hemispherical in shape. Stopper rod 96 is preferably made of graphite, a graphite-based material, or any other suitable material which is well known to those of ordinary skill in the art.

Figure 5:
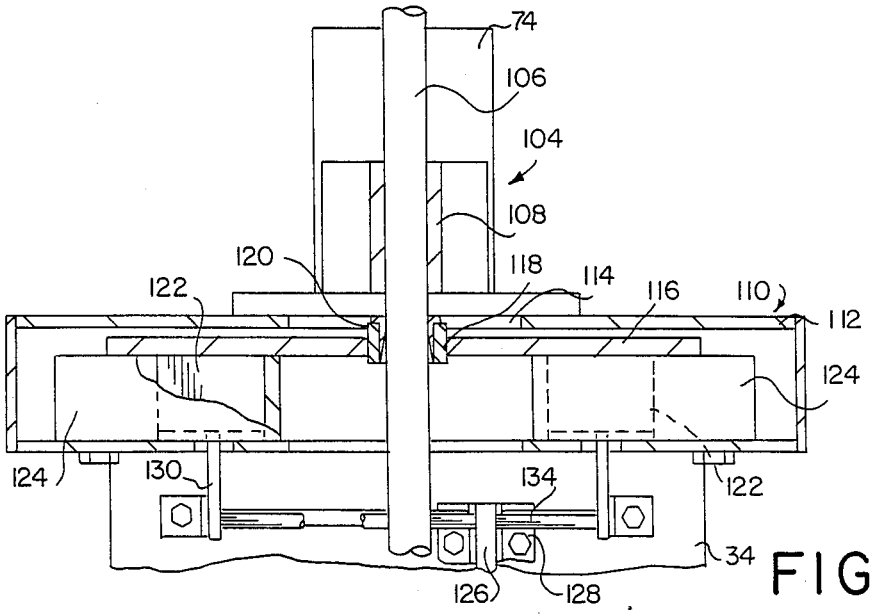
FIG. 5 is an elevational, sectional view of a portion of the instant invention taken generally along lines 5—5 of FIG. 2.

Referring to FIGS. 2, 5 and 6, retractable pin assembly 104 and braking mechanism 110 will be described. Retractable pin assembly 104 comprises a retractable pin 106 which is mounted to the first end 74 of boom 70 via sleeve 108. Pin 106 is engagable with braking mechanism 110 and may be completely removed from braking assembly 110, thereby allowing boom 70 to be completely rotated about longitudinal axis Y—Y. This allows easy access to stopper rod 96 thereby reducing the labor involved in replacing the stopper rod. Pin 106 is free to slide vertically within braking mechanism 110. Pin 106 is moved by a lever (not shown) but well known in the art.

Braking mechanism 110 is affixedly mounted to base 32 via wall 34. Brake housing 112, mounted to housing 31 in any conventional manner, may be a generally rectangular box member. Housing 112 includes an opening 114. A floating plate 116 is located within housing 112 and has dimensions such that floating plate 116 cannot be removed through opening 114 (see FIG. 6.) Coupler 118 located within an opening 114 of floating plate 116 is adapted to engage retractable pin 106. Pin 106 can slide vertically within coupler 118, but cannot move laterally or horizontally within coupler 118. Brake shoes 122 located below floating plate 116 are adapted to force floating plate 116 into engagement with housing 112, thereby locking floating plate 116 into position against housing 112, as will be explained in greater detail below. Brake shoe housing 124 holds brake shoes 122 in place within housing 112.

Brake shoes 122 are movable to and away from floating plate 116 by lever arm 126, for example. Preferably, however, brake shoes 122 are actuated by pneumatic or hydraulic cylinders which are well known. A base 128 is affixed to wall 34. Brake shoe linkage 130, a generally L-shaped member, is pivotably mounted on base 128 and is pivotally connected to shoe 122. Lever arm 126 is pivotably connected to linkage 130 and to base 128 via lever arm 132. Movement of lever arm 126 toward wall 34 engages brake mechanism 110 and movement of lever arm 126 away from wall 34 disengages brake mechanism 110.

Referring to FIG. 6, boom 70 is rotatable about longitudinal axis Y—Y (arrow A) and swingable about axis Y'—Y' (arrow B), so that the resultant motion (arrow C) allows alignment of stopper rod 96 and nozzle 18. When aligning rod 96 and nozzle 18, brake mechanism 110 is disengaged and retractable pin 106 is placed through floating plate 116, thus movement of boom 70 along the motion shown as arrows A and B allows precise alignment of stopper rod 96 with nozzle 18. After proper alignment is obtained, braking mechanism 110 is engaged and thereby holding this aligned position by locking plate 116. If stopper rod 96 should need to be replaced, braking mechanism 110 remains engaged and retractable pin 106 is removed. This allows boom 70 to be swung away from reservoir 12, after the clamp assembly 78 has been unlocked. After replacement of rod 96, boom 70 is swung over reservoir 12, then pin 106 is placed in braking mechanism 110 and stopper rod 96 is already aligned, because plate 116 is locked in place.

Referring to FIG. 1, stopper rod 96 may be moved in the direction of arrow D, by actuation of servomotor 50. Actuation of servomotor causes stopper rod 96 to move in direction D thereby engaging or disengaging conical tip 98 of stopper rod 96 with nozzle 18 or controlling the distance between tip 98 and nozzle 18 which controls the flow rate through the nozzle.

The present invention may be embodied in other specific forms without departing from the spirit or essential attributes thereof and, accordingly, reference should be made to the appended claims, rather than to the foregoing specifications, as indicating the scope of the invention.

We claim:

1. A stopper rod spatial control mechanism for use with a bottom discharge holding reservoir for molten metal having a nozzle, comprising a base;

an outer tube having a longitudinal axis perpendicular to said base, said outer tube being swingably mounted about an axis parallel to and spaced away from said longitudinal axis;

an inner tube telescopically mounted within said outer tube, and being reciprocally movable along said longitudinal axis and being rotatable about said longitudinal axis;

a servomotor fixedly mounted at a lower end of said outer tube;

a ball screw connected to said servomotor;

a ball nut affixed to said inner tube and cooperating with said ball screw;

a boom having a first end and a second end, being affixed to said inner tube adjacent said first end and being rotatable with said inner tube about said longitudinal axis;

a stopper rod depending from said second end of said boom; and means operatively associated with said boom for braking said boom;

whereby said stopper rod is aligned with the nozzle by the combined movements of rotating said inner tube about said longitudinal axis and swinging said outer tube about said axis parallel to said longitudinal axis, then fixing said alignment via said braking mechanism, and thereafter reciprocally moving said stopper rod above the nozzle by actuation of said servomotor.

2. A stopper rod spatial control mechanism for use with a bottom discharge reservoir for molten metal having a nozzle, comprising:

a base;

an outer tube having a longitudinal axis perpendicular to said base;

said outer tube being swingably mounted about an axis parallel to and spaced away from said longitudinal axis;

an inner tube telescopically mounted within said outer tube, being reciprocally movable along said longitudinal axis, and being rotatable about said longitudinal axis;

a boom having a first end and a second end, said boom being affixed to said inner tube adjacent said first end and being rotatable with said inner tube about said longitudinal axis;

a stopper rod depending from said second end of said boom; and means for braking affixed to a member connected to said base and cooperating with said boom;

whereby said stopper rod is aligned with the nozzle by the combined movements of rotating said inner tube about said longitudinal axis and swinging said outer tube about said axis parallel to said longitudinal axis, and then fixing said alignment via said braking means.

3. A stopper rod spatial control mechanism for use with a bottom discharge reservoir for molten metal having a nozzle comprising:

a base;

a stationary axis perpendicular to said base;

a mobile axis parallel to and spaced away from said stationary axis;

first means for reciprocal rotation about said stationary axis;

second means for rotation about said mobile axis and for reciprocal motion along said mobile axis, said second means being connected to said first means;

a boom affixed to said second means;

a stopper rod attached to said boom remotely from said mobile axis and being parallel to said stationary axis;

whereby said stopper rod is aligned over the nozzle by the combined rotations of said first and second means and thereafter controlling the flow of molten metal through the nozzle by said reciprocal motion of said second means.

4. The mechanism according to claims 1 or 2, further comprising a pivot assembly affixed to said base and said outer tube, said assembly defining said axis parallel to and spaced away from said longitudinal axis, and said pivot assembly allowing said outer tube to be swingable about said axis parallel to and spaced away from said longitudinal axis.

5. The mechanism according to claim 4 wherein said pivot assembly further comprises at least two pivot assemblies vertically aligned and defining said axis parallel to and spaced away from said longitudinal axis.

6. The mechanism according to claims 1 or 2 further comprising a bushing interposed between said inner tube and said outer tube.

7. The mechanism according to claims 1 or 2 further comprising a retractable pin assembly affixed to said first end of said boom and cooperating with said braking means.

8. The mechanism according to claim 7 wherein said pin is reciprocally slidable within and removable from said braking means, such that when said pin is within said braking means the alignment of said stopper rod and the nozzle is fixed and when said pin is removed from said braking means said boom being freely rotatable about said longitudinal axis.

9. The mechanism according to claim 1 further comprising means for controlling said servomotor operatively associated with said servomotor.

10. The mechanism according to claims 1 or 2 or 3 further comprising means for clamping said stopper rod to said boom.

11. The mechanism according to claims 1 or 2 wherein said braking means comprises a housing having an opening therethrough, a floating plate located within said housing and being adjacent said opening, a brake shoe located within said housing and means for forcing said shoe into and out of engagement with said floating plate.

12. The mechanism according to claim 3 further comprising motor means for actuating the reciprocal motion of said second means along said mobile axis.

13. The mechanism according to claim 12 wherein said motor means comprises a servomotor.

14. A stopper rod spatial control mechanism used with a bottom discharge reservoir for molten metal, comprising:

a base;

a stopper rod means for vertical reciprocal movement in relation to said base;

an electric servomotor for controlling the vertical reciprocal movement of said stopper rod means, said electric servomotor being operatively associated with said stopper rod means via a ball screw operatively associated with said electric servomotor and a ball nut operatively associated with said stopper rod means, said ball screw engaging said ball nut.

15. The mechanism according to claim 14 wherein said ball screw is a high pitch ball screw.

* * * * *